US005540281A

United States Patent [19]

Round

[11] Patent Number: 5,540,281

[45] Date of Patent: Jul. 30, 1996

[54] METHOD AND APPARATUS FOR TESTING NONERUPTIVE WELLS INCLUDING A CAVITY PUMP AND A DRILL STEM TEST STRING

[75] Inventor: Bernard J. Round, Lardy, France

[73] Assignee: Schlumberger Technology Corporation, Houston, Tex.

[21] Appl. No.: 385,211

[22] Filed: Feb. 7, 1995

[51] Int. Cl.[6] ..... E21B 47/00

[52] U.S. Cl. ..... 166/250.17; 166/106; 418/48

[58] Field of Search ..... 166/250.15, 250.17, 166/264, 106, 105; 418/48

[56] References Cited

U.S. PATENT DOCUMENTS

| | | | |
|---|---|---|---|
| 4,029,443 | 6/1977 | Burnside et al. . | |
| 4,140,444 | 2/1979 | Allen . | |
| 4,325,682 | 4/1982 | Willis . | |
| 4,592,427 | 6/1986 | Morgan . | |
| 4,669,961 | 6/1987 | Lorett . | |
| 4,797,075 | 1/1989 | Edwards et al. . | |
| 4,923,376 | 5/1990 | Wright . | |
| 4,948,432 | 8/1990 | Leach . | |
| 5,220,829 | 6/1993 | Manke et al. | 166/264 X |
| 5,277,254 | 1/1994 | Rullman et al. . | |

*Primary Examiner*—William P. Neuder
*Attorney, Agent, or Firm*—J. H. Bouchard

[57] ABSTRACT

A wellbore apparatus adapted to be disposed in a wellbore includes a perforator adapted for perforating a formation penetrated by the wellbore and producing a wellbore fluid from the formation, a drill stem test string connected to the perforator, the drill stem test string including standard drill stem test equipment, such as a test valve and a reversing valve, and a drill pipe connected to the drill stem test string. When the wellbore fluid produced from the formation and entering the test valve fails to have enough natural formation pressure to travel uphole through the drill pipe to a surface of the wellbore, the wellbore fluid must be pumped uphole. A progressing cavity pump is connected to the drill pipe. More particularly, the cavity pump includes a stator, and the stator is connected to the drill pipe. A rotor of the cavity pump is enclosed by the stator and is connected to a sucker rod and a drive head. The drive head rotates the sucker rod and rotates the rotor of the cavity pump when the rotor is enclosed by the stator. The rotation of the rotor of the cavity pump will produce a negative pressure region within the drill pipe, and this negative pressure region will draw the wellbore fluid uphole through the drill pipe to the surface of the wellbore.

18 Claims, 1 Drawing Sheet

METHOD AND APPARATUS FOR TESTING NONERUPTIVE WELLS INCLUDING A CAVITY PUMP AND A DRILL STEM TEST STRING

BACKGROUND OF THE INVENTION

The subject matter of the present invention relates to a wellbore apparatus including a drill stem test apparatus connected to a perforating apparatus and a special pump known as a progressing cavity pump, the perforating apparatus perforating the wellbore thereby producing a wellbore fluid from a formation penetrated by the wellbore, the drill stem test apparatus opening a valve thereby receiving the wellbore fluid and the progressing cavity pump pumping the wellbore fluid from the valve to the surface of the wellbore.

Noneruptive wellbores are defined to be those wellbores which penetrate a formation that lacks a natural formation pressure which is necessary to push a flowing wellbore fluid uphole to a surface of the wellbore. When a perforator and a drill stem test string is disposed in a wellbore, the perforator perforates the formation thereby producing a wellbore fluid from the formation and the drill stem test string receives the wellbore fluid. The received wellbore fluid flows from the drill stem test string, through a tubing string, and uphole to a surface of the wellbore. In a noneruptive wellbore, there is not enough natural formation pressure in the formation penetrated by the noneruptive wellbore to push the wellbore fluid in the tubing string uphole to a surface of the wellbore. Consequently, in the noneruptive wellbore, a negative pressure producing apparatus is needed in combination with the perforator, drill stem test string and attached tubing string for creating a negative pressure region within the tubing string. The negative pressure region created by the negative pressure producing apparatus draws the wellbore fluid up the tubing string and transports the wellbore fluid uphole to a surface of the wellbore.

However, when a prior art negative pressure producing apparatus was connected to a conventional drill stem test string in a wellbore for the purpose of pumping a well effluent uphole, the prior art negative pressure producing apparatus suffered from several distinct disadvantages. For example, in some cases, the prior art negative pressure producing apparatus included downhole motors, downhole cables, and packer/well head feed throughs adapted for allowing the downhole cables to pass through the packer and well head. Furthermore, when a particular prior art negative pressure producing apparatus (known as a jet pump) was used with a drill stem test string, a particular wellbore fluid being pumped uphole included more than just well effluent. As a result, when the particular wellbore fluid (which was laden with more than just well effluent) was pumped uphole, such fluid would complicate the surface processing of such fluid. In addition, when the prior art negative pressure producing pump apparatus was utilized (e.g., a submersible pump), it was often necessary to withdraw both the pump apparatus and the tubing string from the wellbore.

Consequently, a new type of negative pressure producing apparatus is needed for use downhole in combination with other wellbore apparatus adapted to be disposed in a wellbore, such as a perforator and a drill stem test string. The new negative pressure producing apparatus should produce a negative pressure region within the tubing string thereby allowing a wellbore fluid, flowing from a formation penetrated by the wellbore, to be drawn uphole; however, the new negative pressure producing apparatus should not suffer from any of the above referenced disadvantages which were normally associated with the prior art negative pressure producing apparatus, especially when used in combination with other wellbore apparatus, such as a perforator and a drill stem test string.

In U.S. Pat. No. 4,592,427 to Morgan, a through-the-tubing progressing cavity pump having a stator is run into a nipple of a tubing string in a well when the well is completed. Since the stator is run through the tubing string, either the tubing must be longer than the cavity pump or the cavity pump must be smaller than the tubing string relative to normal application. In addition, the Morgan patent addresses permanent completions, not drill stem test strings. Furthermore, the Morgan patent addresses wells that are self flowing in early life, but are expected to need pumping some time later, and, as a result, the completion string of the Morgan patent utilizes a nipple that will allow installation of a pump, when required, without recompleting the well. The production market for the well of the Morgan patent is several years, that is, the production market for the well of the Morgan patent does not involve the testing of non-flowing wells for a few hours to a few days.

SUMMARY OF THE INVENTION

Accordingly, it is a primary object of the present invention to provide a new wellbore apparatus adapted to be disposed in a wellbore including a drill stem test assembly and a progressing cavity pump connected to the drill stem test assembly.

It is a further object of the present invention to provide a new wellbore apparatus, adapted to be disposed in a wellbore, which is capable of testing non-flowing wells for a few hours to a few days, the new wellbore apparatus including a drill stem test assembly connected between a perforating apparatus and one end of a tubing string and a progressing cavity pump connected to the other end of the tubing string for pumping a well effluent uphole which is flowing from a formation penetrated by the wellbore into the drill stem test assembly.

It is a further object of the present invention to provide a new wellbore apparatus, adapted to be disposed in a wellbore which penetrates a formation, where the new wellbore apparatus includes a standard perforator, a drill stem test assembly interconnected between the perforator and one end of a tubing string, and a progressing cavity pump having a stator connected in the tubing string and enclosing a rotor for receiving wellbore fluid from a set of perforations in the formation and into a set of valves of the drill stem test assembly and for rotating the rotor of the cavity pump thereby pumping the wellbore fluid from the set of valves through the tubing string and to a surface of the wellbore.

It is a further object of the present invention to provide a new negative pressure producing apparatus for use downhole in combination with other wellbore apparatus, such as a perforator and a drill stem test string, the new negative pressure producing apparatus having no complicated apparatus, such as downhole motors, downhole cables, or packer/wellhead feedthroughs and pumping only well effluent thereby simplifying the surface processing of such well effluent.

It is a further object of the present invention to provide a new negative pressure producing apparatus for use downhole in combination with the other wellbore apparatus, such as a drill stem test string and a perforating apparatus, the new negative pressure producing apparatus being retrievable from the wellbore without simultaneously requiring the retrieval of the entire tubing string from the wellbore thereby allowing stimulation or wireline operations to continue and allowing the well to flow on its own when water or gas cut changes during a drill stem test.

It is a further object of the present invention to provide a new negative pressure producing apparatus for use downhole in a wellbore in combination with other wellbore apparatus, such as a perforator and a drill stem test string, the new negative pressure producing apparatus including a progressing cavity pump which further includes a double internal helical stator which forms a part of a tubing string in the wellbore and a single helical rotor which rotates inside the double internal helical stator.

In accordance with these and other objects of the present invention, a wellbore apparatus adapted to be disposed in a wellbore includes a perforator adapted for perforating a formation penetrated by the wellbore and a drill stem test string, the drill stem test string including standard drill stem test equipment, such as a test valve and a reversing valve. In accordance with the present invention, when a wellbore fluid produced from a formation penetrated by the wellbore and entering the test valve fails to have enough natural formation pressure to travel uphole from the drill stem test string and through a tubing string to the surface, a progressing cavity pump is connected to the tubing string, the cavity pump functioning to produce a negative pressure region within the tubing string. The cavity pump produces the negative pressure region which functions to draw the wellbore fluid uphole through the tubing string to the surface of the wellbore. The progressing cavity pump includes a double internal helical stator which is connected to the tubing string and a single helical rotor adapted to be disposed within the stator which rotates within the double internal helical stator and pumps a well effluent uphole. Two chains of lenticular, sealed, spiral cavities are formed between the rotor and stator of the cavity pump forming a plurality of undulations, the sealed cavities spiraling up the pump and carrying the wellbore fluid up the tubing string to the wellbore surface. Since the stator of the cavity pump is connected to and forms a part of the tubing string in the wellbore, the progressing cavity pump can be used in combination with other wellbore apparatus, such as a drill stem test apparatus and a perforator in a wellbore. As a result, no downhole motors are used, and no downhole cables and packer/wellhead feed throughs are utilized. The only wellbore fluid pumped uphole is a well effluent which makes the surface processing of the effluent much easier. The progressing cavity pump can be retrieved from the wellbore without simultaneously requiring the retrieval of the entire tubing string from the wellbore thereby allowing stimulation or wireline operations to continue and allowing the well to flow on its own if water or gas cut changes during a drill stem test. In addition, pressure and temperature surface read out from below the downhole tester valve can be obtained.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
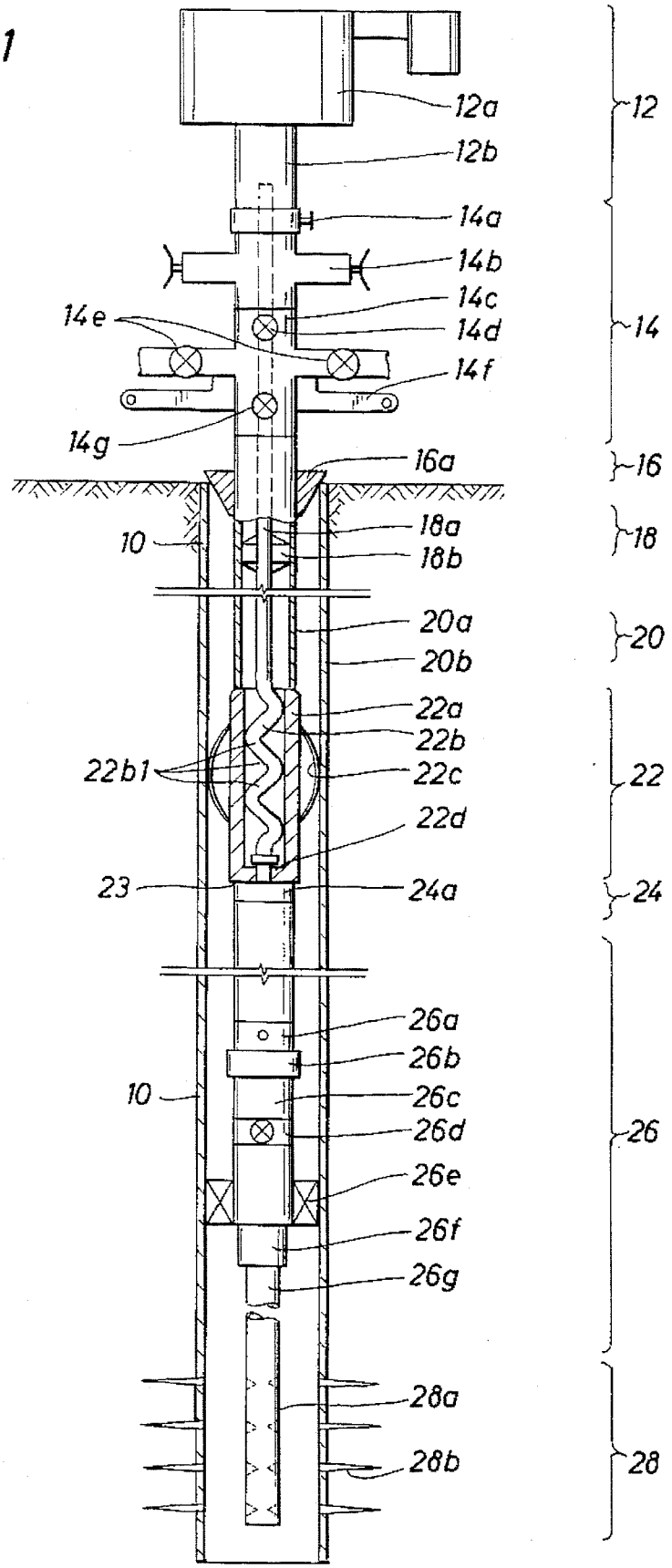
FIG. 1 illustrates a wellbore apparatus in accordance with a preferred embodiment of the present invention which includes a unique combination of well tools, the wellbore apparatus including a perforator, a drill stem test string connected to the perforator, a tubing string connected to the drill stem test string, and a conventional progressing cavity pump having a stator which is connected to the tubing string and a rotor which is adapted to be enclosed by the stator for pumping well effluent uphole.

Referring to FIG. 1, a new wellbore apparatus is shown disposed in a wellbore 10. The wellbore apparatus, which includes a plurality of sections, comprises a drill stem test assembly connected to a progressing cavity pump.

A first section 12 of the new wellbore apparatus is standard equipment provided by a progressing cavity pump manufacturer and it includes a power head 12*a* which may be either an electrical, hydraulic, diesel, or pneumatic power head, and a drive head 12*b*.

A second section 14 of the new wellbore apparatus includes a purge valve 14*a*, a blow out preventer (BOP) 14*b*, a flow head 14*c*, a swab valve 14*d*, a pair of kill/production valves 14*e*, a lifting lug 14*f*, and a master valve 14*g*.

A third section 16 of the new wellbore apparatus includes a pair of slips 16*a*.

A fourth section 18, provided by the cavity pump manufacturer, includes a sucker rod 18*a* and a centralizer 18*b* for centralizing the sucker rod 18*a* inside the tubing/drill pipe 20*a*.

A fifth section 20, provided by a client of the service company, includes the tubing/drill pipe 20*a* and a casing 20*b* which encloses the drill pipe 20*a*.

A sixth section 22, provided by a standard cavity pump manufacturer, is a progressing cavity pump 22, the progressing cavity pump 22 including a stator 22*a* which is connected to and forms a pan of the tubing string/drill pipe 20*a*, a rotor 22*b* enclosed by the stator 22*a*, a centralizer 22*c* for centralizing the stator 22*a* of the cavity pump within the casing 20*b*, and a stop bushing 22*d*. The cavity pump produces a negative pressure region within the tubing string/drill pipe 20*a* which functions to draw the wellbore fluid uphole through the tubing string to the surface of the wellbore. The progressing cavity pump includes a double internal helical stator 22*a* which is connected to the tubing string and a single helical rotor 22*b* adapted to be disposed within the stator and which rotates within the double internal helical stator 22*a* and pumps a well effluent uphole. Two chains of lenticular, sealed, spiral cavities are formed between the rotor and stator of the cavity pump, thereby forming a plurality of undulations 22*b*1, the sealed cavities spiraling up the pump and carrying the wellbore fluid up the tubing string to the wellbore surface. For more information about the cavity pump, refer to U.S. Pat. No. 4,592,427 to Morgan, the disclosure of which is incorporated by reference into this specification.

The seventh section 24 includes a check valve 24*a*.

The eighth section 26 is a standard drill stem test assembly and includes a reversing valve 26*a*, a wireless telemetry control tool 26*b* (hereinafter referred to by acronym as "WTCT 26b"), a drill stem test gauge adaptor 26c (hereinafter referred to by acronym as "DGA 26c") capable of holding up to four downhole recorders (DHR), the DHR's being adapted for measuring temperature and pressure in the wellbore 10, a tester valve 26d, a packer 26e, a gauge carrier 26f, and a mule shoe 26g. When a drill stem test gauge adaptor (DGA) 26c is associated with the wireless telemetry control tool (WTCT) 26b in the wellbore 10 of FIG. 1, one can read the pressure and/or temperature reading from the DHR's on surface in real time, i.e., downhole pressure and temperature from below the tester valve 26d can be read in real time on the surface of the wellbore with the cavity pump 22 in place. The DHR's of the DGA's 26c and the WTCT 26b are part of the drill stem test assembly 26 of FIG. 1; however, it should be noted that the WTCT 26b is the only method of having surface readout with the pump 22 in place.

The ninth section 28 includes a perforating gun 28a which produces perforations 28b in the formation penetrated by the wellbore 10.

The progressing cavity pump 22 is a standard progressing cavity pump, such as Rodemip or other similar models like the progressing cavity pump disclosed in U.S. Pat. No. 4,592,427 to Morgan, the disclosure of which is incorporated by reference into this specification. The cavity pump 22 is normally set at about 1000 feet to 8000 feet below the surface of the wellbore 10. The drill stem test assembly 26 can include the standard drill stem test tools, such as a pressure controlled tester, an Intelligent Remote Implementation System (IRIS) as disclosed in U.S. Pat. No. 4,915,168 to Upchurch and its reexamination certificate B1 U.S. Pat. No. 4,915,168 to Upchurch, a multi-flow evaluator, and an inflate packer. Data acquistion can be accomplished by the wireless telemetry of the WTCT 26b (or alternately by using a latched inductive coupler like that disclosed in U.S. Pat. No. 4,901,069 to Veneruso with a multisensor recorder transducer like that disclosed in U.S. Pat. No. 4,553,428 to Upchurch). In addition, most combinations of tubing conveyed perforating can be used in connection with the perforating gun 28a. The full bore check valve 24a could be installed below the stator stop bushing 22d and would be locked open when the stator 22a is in place or locked open with a wireline tool if required for safety reasons. On the surface of the wellbore, a Tee flow head 14c has a master valve 14g which is used only when the cavity pump 22 is not in place. The flow head 14c is equipped with a lifting bracket 14f for use during multi flow evaluator (MFE) operations. On top of the flow head 14c, a blowout preventor (BOP) 14b has rams to match the outer diameter of a polished rod to protect the drive head assembly 12b in case the well comes in or in case of any operation requiring pumping through tubing with the sucker rod 18a in place. A stripper BOP 14b could also be installed in the event the rotor 22b of the cavity pump 22 must be lifted several meters out of the stator 22a for stimulation, kill fluid injection, or to check if the well is eruptive. Above the BOP 14b, the standard drive head 12b with bearings and seal assembly are provided by the cavity pump 22 manufacturer. Above the drive head 12b, a standard power pack 12a is provided with various options.

A functional description of the operation of the new wellbore apparatus of the present invention of FIG. 1, including the progressing cavity pump 22, the drill stem test apparatus 26, and the perforating apparatus 28a, is set forth in the following paragraphs with reference to FIG. 1 of the drawings.

In FIG. 1, the perforator 28a, the drill stem test assembly 26, the check valve 24 (optional), the stator of the progressing cavity pump 22a, the stator centralizer 22c, and the drill pipe 20a are run into the wellbore to a calculated depth in the wellbore, the calculated depth being that depth where perforations 28b will be formed in the formation and where a well fluid will be produced from the formation. At the calculated depth, the packer 26e is set. AT this point, the perforator 28a perforates the formation penetrated by the wellbore 10 and well fluid begins to flow into an open tester valve 26d of the drill stem test assembly 26. However, if there is not enough natural formation pressure to push the well fluid, entering the tester valve 26d, uphole to a surface of the wellbore, the cavity pump 22 will be used to create a negative pressure region within the drill stem test assembly 26 to draw the well fluid uphole. At this stage, the tester valve 26d will be closed to allow an initial pressure buildup to occur, to permit recording, to secure the well, and to allow the rotor assembly to be run into drill pipe 20a. The rotor 22b of cavity pump 22 is first connected to the sucker rod 18a, and, then, the rotor 22b and sucker rod 18a are lowered into the bore of the stator 22a until the rotor 22b is fully enclosed within the stator 22a. The sucker rod 18a is centralized within the drill pipe 20a by the centralizer 18b. The flow head 14c, BOP 14b, purge valve 14a, drive head 12b, and power head 12a are connected to the sucker rod 18a as shown in FIG. 1. When the tester valve 26d is reopened, the drive head 12b, powered by power head 12a, rotates the sucker rod 18a. Since the rotor 22b, which is connected to the sucker rod 18a, includes the plurality of undulations 22b1 and spiral cavities are formed between the undulations 22b1 of the rotor 22b and the stator 22a, when the sucker rod 18a rotates, the undulations 22b1 of the rotor 22b will appear to move uphole thereby creating the negative pressure region within the drill stem test assembly 26. The moving undulations 22b1 will draw the well fluid from the tester valve 26d uphole to the surface of the wellbore.

Consider the following installation and test procedure associated with the new wellbore apparatus of FIG. 1, which describes in detail how the wellbore apparatus of FIG. 1 is installed in the wellbore 10 and how a typical drill stem test is performed.

1. Begin by running the drill stem test (DST) assembly 26 of FIG. 1 into the wellbore, the DST assembly 26 including the reversing valve 26a, the WTCT 26b, the DGA 26c, the tester valve 26d, the packer 26e, the gauge carrier 26f, and the mule shoe 26g. It is assumed that the perforating apparatus 28a has not yet perforated the formation penetrated by the wellbore 10 and that the perforations 28b do not yet exist in the formation. If the new wellbore apparatus of FIG. 1 is used in open-hole, no perforating will take place.

2. Continue running the DST assembly 26, along with a second associated drill pipe or tubing, to a calculated depth in the wellbore 10, the calculated depth being greater than that depth in the wellbore to which a well effluent or other wellbore fluid is expected to be naturally produced from a formation penetrated by the wellbore 10 and where a pump, such as the cavity pump 22, can begin pumping the well effluent to the surface of the wellbore.

3. Connect the stator 22a of a progressing cavity pump 22 to a third associated drill pipe 20a or tubing string 20a and run the stator 22a into the wellbore 10 until the stator 22a of the cavity pump 22 is connected, at connection 23, to the second drill pipe of item 2 above, or to the check valve 24a, the stator 22a being connected to the second drill pipe or check valve 24a at a connection 23 shown in FIG. 1.

4. When the string is at the calculated test depth, install the flow head 14c (also known as a flow tee test tubing) by connecting the flow head 14c to the drill pipe 20a; then, adjust the cushion, and set packer 26*e*; open the tester valve 26*d*; using the perforating gun 28*a*, perforate the formation penetrated by the wellbore; then, close the tester valve 26*d*, and, using the DST gauge adaptor (DGA) 26*c*, obtain a reading of pressure in the wellbore. Using the WTCT 26*b*, transmit that pressure reading uphole to the surface of the wellbore.

5. Connect the rotor 22*b* of the cavity pump 22 to the sucker rod 18*a* and run the rotor 22*b* with attached sucker rod 18*a* into the wellbore 10 until the rotor 22*b* is disposed within the stator 22*a* of the progressing cavity pump 22 as shown in FIG. 1. Space out (i.e., centralize) the sucker rod 18*a* in the wellbore 10. Then, install the drive head 12*b* and the power head 12*a*.

6. Open the tester valve 26*d*. A well effluent, produced from a formation penetrated by the wellbore 10, will enter the open tester valve 26*d*.

7. Start the cavity pump 22. When the cavity pump 22 is started, power head 12*a* will provide the necessary power to the drive head 12*b*; and, in response, the drive head 12*b* will rotate the sucker rod 18*a* circumferentially. When the sucker rod 18*a* is rotated, since the rotor 22*b* is connected to the sucker rod 18*a*, the rotor 22*b* will also be rotated circumferentially. Note that the rotor 22*b* includes a plurality of undulations 22*b*1. Since the rotor 22*b* has the plurality of undulations 22*b*1, when the rotor 22*b* rotates, the undulations 22*b*1 of the rotor 22*b* will flow the well effluent, which is entering the tester valve 26*d*, uphole to a surface of the wellbore.

8. Stop the cavity pump 22. The rotor 22*b* stops rotating. Close the tester valve 26*d*. Wait for a build up of a pressure of the well effluent at the closed tester valve 26*d*.

9. Repeat steps 7 and 8, above, as necessary.

If stimulation is required, do steps 10 and 11 as follows:

10. If stimulation is required, remove the drive head 12*b* and the power head 12*a*. Pull the rotor 22*b* of the cavity pump 22 and the sucker rod 18*a* out of the wellbore apparatus of FIG. 1.

11. Close the swab valve 14*d* and perform the required stimulation. Note that, in some cases, this operation could be performed without retrieving the rotor 22*b* by lifting the rotor 22*b* out of the stator 22*a* and sealing on the surface polished rod with the BOP 14*b*. In this case, a slip BOP or a positive lock on the sucker rod 18*a* should be installed to prevent the sucker rod 18*a* from being pumped out of the well. This will be determined by the weight of the sucker rod 18*a* plus the rotor 22*b* and by the stimulation pressure versus the cross section of the sucker rod 18*a*.

12. Re-test the well by repeating steps 7, 8, and 9, as outlined above.

13. Retrieve the rotor 22*b* of the cavity pump 22 along with the sucker rod 18*a* (pull the rotor 22*b* and sucker rod 18*a* out of the wellbore apparatus of FIG. 1).

14. Kill the well (i.e., secure the well) according to standard drill stem test practice.

15. Unset the packer 26*e* and pull the stator and the entire drill stem test assembly 26 out of the wellbore 10 of FIG. 1.

The above steps 1 through 15 represent a basic single zone drill stem test. In addition, or in the alternative, many other various options are possible for performing other drill stem tests.

The invention of this application represents, among other things, a new method of testing noneruptive wells at variable rates from a perforated casing/liner or open hole and, in addition, the option of real time pressure surface read out. By adapting a progressing cavity pump 22 downhole between a surface variable mechanical drive 12*b* and a pressure or pulse operated drill stem test string 26, one can pump well effluent or other wellbore fluid from a formation penetrated by the wellbore 10 to a surface of the wellbore.

By using the new wellbore apparatus of FIG. 1, the possibilities are as follows:

When a single drill stem test assembly 26 and associated cavity pump 22 of FIG. 1 are run into a nonflowing well, one can: (1) perforate, (2) produce the well at various rates, (3) build up using the downhole shut in or tester valve 26*d*, (4) stimulate, (5) repeat the drill stem test sequence, as necessary, (6) acquire downhole pressure and temperature data, (7) take downhole samples, (8) pull the cavity pump rotor 22*b* and/or drill stem test assembly 26 out of hole, and (9) perform multiple zone drill stem testing without pulling the test string 26 out of the hole (inflate).

The advantages of the new wellbore apparatus of FIG. 1 over present systems are as follows: no downhole motors, no downhole cables or packer/well head feed through, only well effluent is produced making surface processing much easier (as opposed to jet pumps), the rotor 22*b* can be retrieved without pulling the drill stem test string 26 to allow stimulation or wireline operations or to allow the well to flow on its own if water or gas cut changes during the drill stem test, and when associated with the WTCT 26*b*, pressure and temperature read out from below the tester valve 26*d* can be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A wellbore apparatus adapted to be disposed in a wellbore, comprising:

a drill stem test string;

a progressing cavity pump connected to said drill stem test string, said cavity pump including a stator and a rotor, said stator being connected to said drill stem test string; and a tubing sting connected on one end to said drill stem test string said stator being connected to the other end of said tubing string.

2. The wellbore apparatus of claim 1, wherein a well fluid flows from a formation penetrated by said wellbore into said drill stem test string, further comprising:

a sucker rod connected to said rotor adapted to be lowered into said cavity pump, said rotor of said cavity pump adapted to be enclosed by said stator of said cavity pump when said sucker rod is lowered into said cavity pump, said sucker rod adapted to be rotated, said rotor rotating within said stator when said sucker rod is rotated, said rotor pumping said well fluid uphole to a surface of said wellbore when said rotor rotates within said stator.

3. The wellbore apparatus of claim 2, further comprising:

a flow head connected to the stator of said cavity pump.

4. The wellbore apparatus of claim 3, further comprising:

a blowout preventor connected to said flow head.

5. The wellbore apparatus of claim 4, further comprising:

a power head connected to said blowout preventor.

6. The wellbore apparatus of claim 2, further comprising:

a perforating apparatus connected to said drill stem test string adapted to perforate a formation penetrated by said wellbore, said well fluid flowing from said formation when said perforating apparatus perforates said formation, and wherein said drill stem test string comprises:

a tester valve adapted for opening and closing, said well fluid flowing from said formation entering said tester valve when said tester valve is open.

7. The wellbore apparatus of claim 6, further comprising:

a flow head connected to the stator of said cavity pump.

8. The wellbore apparatus of claim 7, further comprising:

a blowout preventor connected to said flow head.

9. The wellbore apparatus of claim 8, further comprising:

a power head connected to said blowout preventor.

10. A method of performing a drill stem test, comprising the steps of:

flowing a wellbore fluid from a formation penetrated by a wellbore;

receiving said wellbore fluid from said formation into a drill stem test assembly, said drill stem test assembly including a tester valve, said wellbore fluid being received from said formation and into said tester valve of said drill stem test assembly when said tester valve is in an open condition, a tubing string being connected to said drill stem test assembly, said wellbore fluid flowing from said tester valve and into said tubing string; and pumping said wellbore fluid from said tubing string to a surface of said wellbore, a progressing cavity pump including a stator and a rotor, said stator of said cavity pump being connected to said tubing string mad adapted to enclose said rotor, said rotor adapted to rotate when enclosed by said stator, the pumping step including the step of, rotating said rotor of said cavity pump when said stator is connected to said tubing string and said rotor is enclosed within said stator, the rotor pumping said wellbore fluid from said tubing string to said surface of said wellbore when said stator of said cavity pump is connected to said tubing string and said rotor rotates within said stator of said cavity pump.

11. The method of claim 10, wherein a perforator perforates said formation penetrated by said wellbore, and wherein the flowing step comprises the step of:

forming perforations in said formation when said perforator perforates said formation; and flowing said wellbore fluid from said perforations in said formation.

12. A method of performing wellbore operations in a wellbore, comprising the steps of:

lowering a drill stem test assembly to a calculated depth in said wellbore, said drill stem test assembly including an outer tubing and adapted to receive a well fluid from a formation penetrated by said wellbore;

lowering a stator of a progressing cavity pump into said wellbore and connecting said stator to said tubing of said drill stem test assembly, said stator having an internal full bore; connecting a rotor of said progressing cavity pump to a conveyor, lowering said rotor and said conveyor into said full bore of said stator until said rotor is enclosed by said stator, rotating said conveyor and rotating said rotor, and in response to the rotation of said rotor, pumping said well fluid from said drill stem test assembly to a surface of said wellbore.

13. A wellbore apparatus adapted to be disposed in a wellbore, comprising:

a first wellbore apparatus adapted to perform an operation in said wellbore, said first wellbore apparatus including an outer tubing, a wellbore fluid flowing within said outer tubing when said first wellbore apparatus performs said operation in said wellbore; and cavity pump means connected to said first wellbore apparatus including a stator and a rotor for pumping said wellbore fluid uphole to a surface of said wellbore, said stator of said cavity pump being connected to said outer tubing of said first wellbore apparatus and adapted to receive said wellbore fluid flowing in said outer tubing, said rotor being enclosed by said stator and being adapted to rotate within said stator, said rotor pumping said wellbore fluid in said outer tubing uphole when said rotor rotates within said stator.

14. The wellbore apparatus of claim 13, wherein said first wellbore apparatus includes a perforating gun.

15. The wellbore apparatus of claim 14, wherein said first wellbore apparatus further includes a drill stem test apparatus, said perforating gun perforating a formation penetrated by said wellbore, said wellbore fluid flowing from the perforated formation, said drill stem test apparatus receiving said wellbore fluid and flowing said wellbore fluid into said outer tubing.

16. A method of performing a wellbore operation in a wellbore, comprising the steps of:

(a) lowering a tubing string into said wellbore, said tubing string adapted to receive a wellbore fluid;

(b) lowering a stator of a cavity pump into said wellbore and attaching said stator to said tubing string;

(c) lowering a rotor of said cavity pump into said tubing string until said rotor is enclosed by said stator, (d) rotating said rotor when said rotor is enclosed by said stator, and (e) pumping said wellbore fluid from said tubing string uphole to a surface of said wellbore in response to the rotating step.

17. The method of claim 16, wherein the lowering step (a) comprises the step of:

lowering a perforating gun, a drill stem test apparatus connected to said perforating gun, and said tubing string connected to said drill stem test apparatus into said wellbore.

18. The method of claim 17, wherein the rotating step (d) comprises the step of:

perforating a formation penetrated by said wellbore in response to the lowering step (c), a wellbore fluid flowing from the perforated formation;

receiving the wellbore fluid from the perforated formation into said drill stem test apparatus;

receiving said wellbore fluid from said drill stem test apparatus into said tubing string; and rotating said rotor when said rotor is enclosed by said stator.

* * * * *